US006497058B2

(12) United States Patent
Dietrich et al.

(10) Patent No.: US 6,497,058 B2
(45) **Date of Patent: *Dec. 24, 2002**

(54) SHOE WITH EXTERNAL TORSION STABILITY ELEMENT

(75) Inventors: Stephan Johannes Karl Dietrich, Nuremberg (DE); Bernhard Knoche, Herzogenaurach (DE)

(73) Assignee: adidas International B.V. (NL)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/516,829

(22) Filed: Mar. 1, 2000

(65) Prior Publication Data

US 2002/0050078 A1 May 2, 2002

(30) Foreign Application Priority Data

Mar. 2, 1999 (DE) ..... 299 03 764 U

(51) Int. Cl.[7] ..... A43B 23/10; A43B 13/14; A43B 7/14; A43B 7/22

(52) U.S. Cl. ..... 36/69; 36/142; 36/30 R; 36/31; 36/88; 36/91

(58) Field of Search ..... 36/142, 143, 144, 36/145, 148, 149, 154, 162, 166, 169, 173, 174, 176, 180, 69, 88, 91, 92, 102, 107, 71, 25 R, 43, 44, 30 R

(56) References Cited

U.S. PATENT DOCUMENTS

| | | | | |
|---|---|---|---|---|
| 2,095,398 A | * | 10/1937 | Reeves | 36/149 |
| 3,586,003 A | * | 6/1971 | Baker | 36/145 |
| 4,638,576 A | | 1/1987 | Parracho et al. | 36/68 |
| 4,642,911 A | | 2/1987 | Talarico, II | 36/30 R |
| 4,766,679 A | | 8/1988 | Bender | 36/30 |
| 4,947,560 A | | 8/1990 | Fuerst et al. | 36/88 |
| 5,297,349 A | * | 3/1994 | Kilgore | 36/114 |
| 5,669,162 A | * | 9/1997 | Dyer | 36/44 |
| 6,119,373 A | * | 9/2000 | Gebhard et al. | 36/114 |

FOREIGN PATENT DOCUMENTS

| | | |
|---|---|---|
| DE | 7216278 | 7/1972 |
| DE | 4101236 | 7/1992 |
| DE | 4228248 | 8/1992 |
| WO | 98/20763 | 5/1998 |
| WO | 98/51178 | 11/1998 |

* cited by examiner

*Primary Examiner*—Anthony D. Stashick
(74) *Attorney, Agent, or Firm*—Testa, Hurwitz & Thibeault, LLP

(57) ABSTRACT

An article of footwear is disclosed, in particular a sports shoe with a sole ensemble and a stability element constructed of a material and configured for the selective support of single parts of the sole ensemble. The stability element includes a base element extending from a rearfoot portion to a forefoot portion of a shoe along the medial or the lateral side of the forefoot portion of the shoe and includes at least one support element. The at least one support element encompasses the sole ensemble upwardly or downwardly or both. Further, the stability element may include a heel support connected to the base element and a second base element for additional lateral support of the shoe.

10 Claims, 4 Drawing Sheets

SHOE WITH EXTERNAL TORSION STABILITY ELEMENT

CROSS-REFERENCE TO RELATED APPLICATION

This application incorporates by reference, and claims priority to and the benefit of, German patent application Ser. No. 29903764.9, which was filed on Mar. 2, 1999.

1. Technical Field

The invention relates to a shoe, in particular to a sports shoe with a sole ensemble including a stability element for the selective support of single parts of the sole ensemble.

2. Background Information

The processes in the human foot during walking or running are enormously complex. Between the first contact of the heel and push-off with the toes, a number of different movements take place throughout the entire foot. During these movements, various parts of the foot move or turn with respect to each other.

It is an objective in the construction of sport shoes to obstruct as little as possible these natural movements, such as they occur in barefoot running, and to support the foot only where it is necessary for the intended use of the shoe.

In this context, it has been realized that the conventional homogenous outsole extending over the entire lower area of the shoe does not meet the above mentioned requirements. In particular, the selective support of single parts of the foot is impossible with a homogeneously formed, continuous outsole or a homogenous sole ensemble.

One objective of selective support in shoes is to avoid excessive pronation or supination of the foot, i.e., the turning of the foot to the medial (inner) or the lateral (outer) side by several degrees. The yielding of a sole consisting of foam materials typically causes this turning movement of the foot. The consequences of pronation or supination are premature fatigue of the joints of the foot and/or the knee and/or injury.

One example of a known stability element to avoid pronation or supination is disclosed in German patent number DE 19 904 744. The patent discloses separate stability elements made out of harder materials selectively integrated into a sole or sole ensemble. The stability elements avoid excessive compression of the heavily loaded parts of the sole. It has been found however, that the hardness of the material of such a stability element, as necessary for noticeable pronation or supination control of the foot, significantly reduces the flexibility of the sole which is needed during the push-off phase.

Another method of avoiding pronation or supination is disclosed in U.S. Pat. No. 4,642,911. This patent discloses local modification of the density, and thereby the hardness, of the materials used in the sole in order to locally influence the compression behavior of the sole. The sole disclosed in this patent makes high demands on production technology and thereby leads to excessive costs for a mass-produced sports shoe.

U.S. Pat. No. 4,638,576 discloses a combination of the two approaches. The patent discloses a midsole produced of two different materials to selectively support the foot and at the same time allow flexibility. Additionally, a heel cover is arranged in the rearfoot portion on top of the sole ensemble that is to support, via an additional damping element, the heel from below and three sides. Apart from the high production costs of this construction, the effective support and guidance of the foot is limited by the comparatively soft sole layers below the heel cover. Further, since the supporting effect of the heel cover is limited to the rear foot area, pronation or supination during the movement subsequent to the first contact with the heel cannot be avoided.

In addition to avoiding the above-mentioned pronation or supination, it is an objective of the stability element of the present invention to selectively support the foot to provide smooth movement of the foot during a step, from the first contact of the heel until the final push-off with the toes. Abrupt changes of the phases of the movement are to be avoided to reduce the risk of injuries and/or premature fatigue of the foot and/or knee joints.

It is therefore an object of the present invention to provide a cost-effective manufacturable shoe having, in desired areas of the sole, an improved compression stability to avoid pronation or supination without the above mentioned disadvantages of known stability elements.

It is a further object of the present invention that the shoe should be capable of providing smooth movement during a step, from the first contact with the ground to the final push-off and to provide thereby a complete system for the selective support of the foot.

SUMMARY OF THE INVENTION

The present invention relates to an article of footwear, in particular a sports shoe, with a sole ensemble and a stability element for the selective support of single parts of the sole ensemble. The stability element includes a base element extending from a rearfoot portion to a forefoot portion of a shoe along the medial or the lateral side of the forefoot portion of the shoe, and includes at least one support element that extends sideways from the base element and encompasses the sole ensemble on the lateral or the medial side. The at least one support element encompasses the sole ensemble upwardly or downwardly or both. Further, the stability element may include a heel support connected to the base element that encompasses the heel portion of the shoe. The sole ensemble of the shoe is not only supported on the medial and/or lateral side of the forefoot portion, but is also enclosed in a "frame-like" manner. Additionally, the shoe may include a second base element for additional lateral support of the shoe.

In one aspect, the invention relates to an article of footwear including a rearfoot portion, a forefoot portion, and a sole ensemble with a stability element. The stability element includes a base element that extends from the rearfoot portion to the forefoot portion. The base element can extend substantially along the medial side of the shoe, or substantially along the lateral side. The base element can include material properties for reducing pronation or supination of a wearer's foot. The stability element further includes at least one support element. The at least one support element extends sideways from the base element and encompasses the sole ensemble on the medial or lateral side. The at least one support element prevents the sole material from expanding to the side under high pressure on the medial and/or lateral side of the forefoot portion. Since the material cannot expand to the side, this restriction or limitation leads to improved resistance of the sole against compression in the area of the forefoot, which is relevant for the control of pronation and supination, effectively avoiding the turning of the foot to the medial or lateral side. The improvement of the compression stability is further increased by the base element itself, which extends in this area of the sole and which can be made of a harder material than the surrounding sole material.

In another aspect, the stability element includes a heel support connected to the base element. The heel support at least partially encompasses the heel portion of the shoe. In one embodiment, the heel support fully encompasses the heel portion. The heel support ensures that the stability element controls the elasticity and thereby the behavior of the shoe from the first contact with the ground on. At the same time, the connection of the heel support to the base element allows a smooth transition of the foot from the landing phase to the push-off phase, since the effect of the stability element does not only start with the first ground contact of the base element as with known stability elements, but with the first ground contact of the heel support.

In one embodiment, the connection between the base element and the heel support has torsional flexibility to allow a turning movement of the base element with respect to the heel support. A stability element according to the invention therefore allows the natural torsional movements of the forefoot portion with respect to the rearfoot portion. In another embodiment, the heel support is formed as a heel shell, including an inner portion that is inserted into the sole and an external portion that is visible from outside the sole.

In yet another aspect, the stability element includes a second base element extending on the opposite side of the forefoot portion with respect to the first base element. The second base element includes additional support elements extending sideways from the second base element and encompassing the sole ensemble on the side opposite the first base element.

In various embodiments of the above-described stability elements, the support element(s) may encompass the sole ensemble by extending upwardly, downwardly, or both over the sole ensemble. For the additional support of certain portions of the foot, the support element(s) may further encompass not only the sole ensemble, but also the foot. Additionally, the base element(s) may include one or more slits which ensure the flexibility of the stability element in the forefoot portion, as necessary, for an unhindered push-off phase. For the support of the longitudinal and/or lateral arch of the foot, the base element(s) may include an additional support element in the forefoot portion. The support element may extend from the side of the stability element. The stability element may also include at least one side element that extends upwardly from the side of the stability element over the edge of the footwear. This embodiment is particularly suited for use in sports with a high lateral strain on the foot.

These and other objects, along with advantages and features of the present invention herein disclosed, will become apparent through reference to the following description of embodiments of the invention, the accompanying drawings, and the claims.

BRIEF DESCRIPTION OF THE DRAWINGS

In the drawings, like reference characters generally refer to the same parts throughout the different views. Also, the drawings are not necessarily to scale, emphasis instead generally being placed upon illustrating the principles of the invention. In the following description, various embodiments of the present invention are described with reference to the drawings in which.

DETAILED DESCRIPTION

According to one embodiment of the present invention, an article of footwear includes a stability element, which is arranged beneath the foot of the wearer. This can be achieved by integrating the stability element in accordance with the present invention into an outsole of the article of footwear, or sandwiching it between the outsole and a midsole, or between the midsole and an insole. If the stability element is arranged within the outsole, it may differ in color from the surrounding material of the sole, so that the special form (which is an indication for which sport the corresponding article is intended) of the stability element can easily be recognized from the outside. According to another embodiment, the outsole itself consists essentially of the stability element. In this case, an optional midsole and an optional insole can be applied to the upper side of the stability element to provide comfort and dampening to the wearer of the article.

The above described different possible arrangements of the stability element do not significantly influence the functional properties of a shoe including a stability element in accordance with the present invention; therefore, reference is made in the following description and in the figures only to an article of footwear in general.

Figure 1:
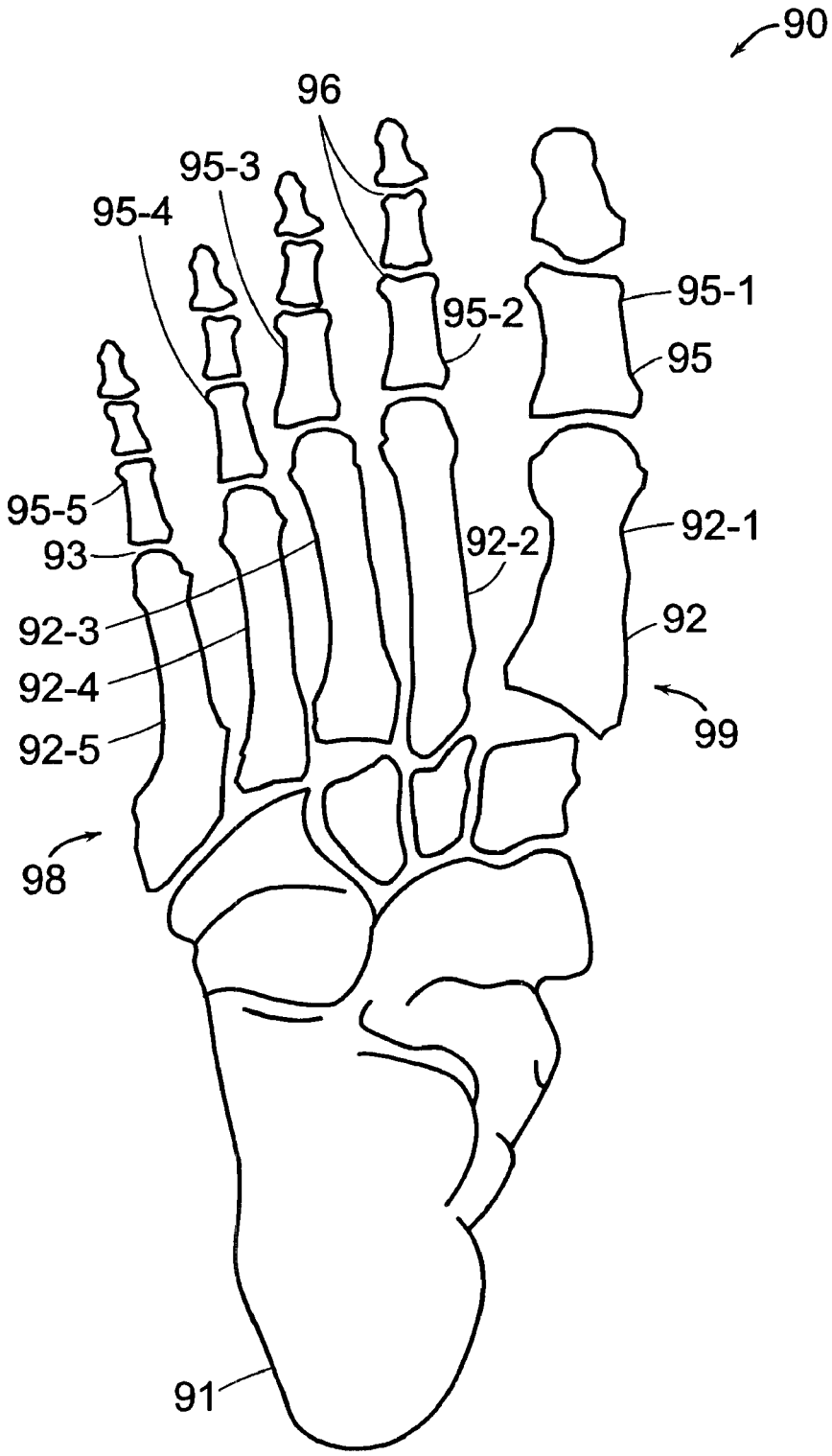
FIG. 1 is a schematic view of a skeleton of a human foot for explaining certain principles of the present invention.

Before the design and the functional characteristics of the stability element in accordance with the present invention are described in detail, reference is made to the skeleton of a human foot 90, as shown in FIG. 1, to facilitate the understanding of the inventive principles with respect to the particular parts of the foot that are selectively supported.

In FIG. 1, reference numeral 92 depicts the metatarsals of a left human foot 90, and reference numeral 95 depicts the phalanges (toes). Essentially, both the metatarsals 92 and the phalanges 95 form the forefoot portion of the foot 90. The metatarsal-phalangeal joints 93 are located between the metatarsals 92 and the phalanges 95. The phalanges 95 include a plurality of interphalangeal joints 96. During a walking or running cycle, the metatarsal-phalangeal joints 93 and the interphalangeal joints 96 allow the foot to flex and push-off from the ground.

Altogether, there are five metatarsals 92 referred to as the first, second, third, fourth, and fifth metatarsals, 92-1 to 92-5, moving from the medial side 99 of the foot 90 to the lateral side 98. Similarly, there are five phalanges, 95-1 to 95-5. Finally, the heel bone 91 is depicted.

For a stability element in accordance with the present invention, it is important for the sake of pronation or supination control to appropriately support the phalanges 95 and the metatarsals 92. In the case of pronation control, metatarsal 92-1 and/or metatarsal 92-2 is supported, preferably with phalange 95-1 and/or 95-2. In the case of supination control, metatarsal 92-5 and/or metatarsal 92-4 is supported, preferably with phalange 95-5 and/or 95-4. The necessary support is provided by a stability element in accordance with the present invention; however, since supination is rarely a problem, and for the sake of conciseness in the following description, only pronation control stability elements are discussed. The present invention is however, not restricted to this field. Complementary shaped stability elements supporting the respective metatarsals and phalanges for supination control are also covered by the present inventive concept.

Figure 2:
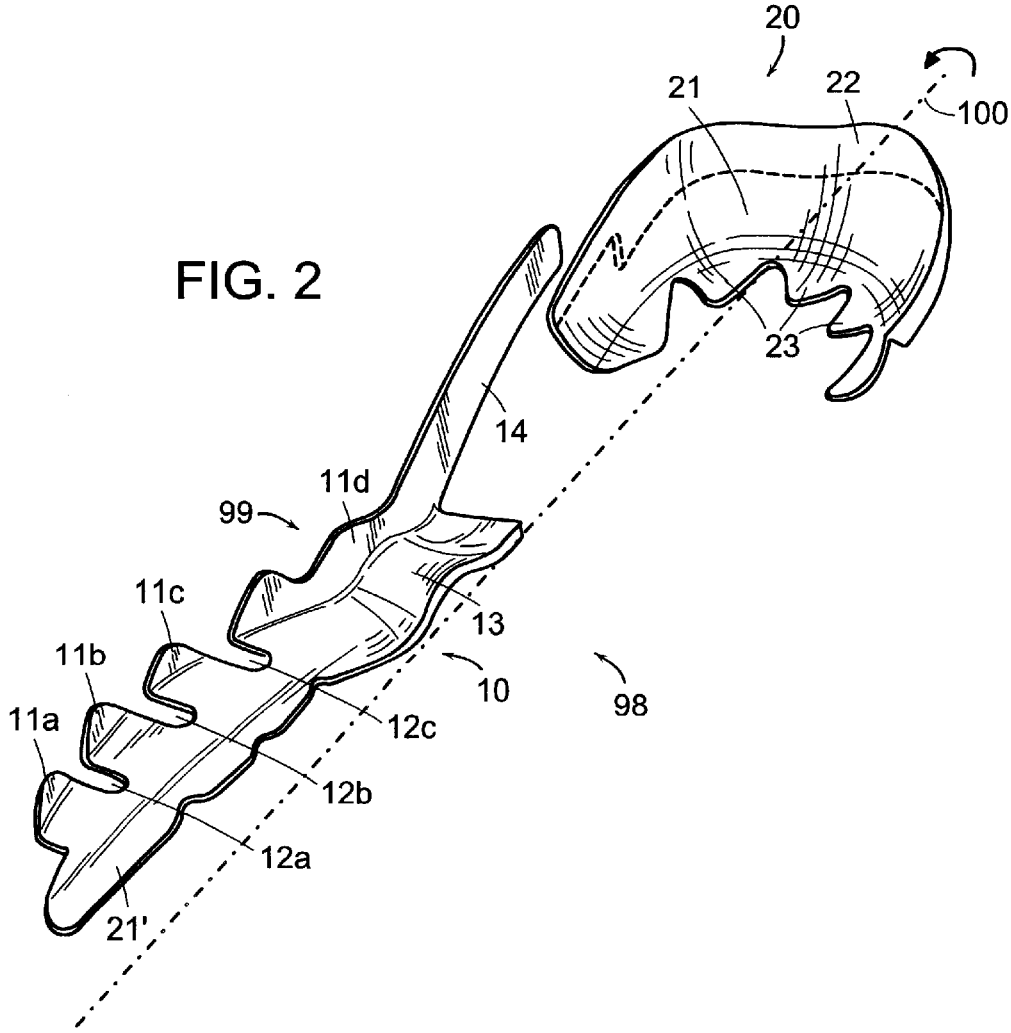
FIG. 2 is a perspective schematic view of an embodiment of a base element and a heel support of a stability element according to the present invention.

FIG. 2 shows a perspective view of one embodiment of a stability element of a left shoe. According to the invention, the stability element includes a base element 10 and an optional heel support 20. In FIG. 2, the two parts are shown separately for clarity; however, they are connected to each other in the final state. For example, the total stability element is either manufactured in one piece, or the two separate parts are glued, welded, or otherwise attached to each other, as shown in FIG. 3.

The base element 10 extends from a rearfoot portion to a forefoot portion of the shoe, generally from the area of the heel bone 91 to the area of the phalanges 95. The base element reinforces the medial or lateral side of the sole ensemble (not shown) in the forefoot portion. The base element tapers horizontally off in the direction of the center of the sole at the distal support element 21. The support elements, 11*a* to 11*d*, are arranged at a right angle along the outside edge of the base element. The support elements extend sideways around the sole area arranged on the base element 10. Without these support elements, the flexible sole material (EVA or other foam materials) would expand to the side under an increased pressure on this portion of the sole and thereby yield to the stress. In contrast thereto, the support elements 11*a* to 11*d* reduce or eliminate such deformation of the medial portion of the sole. The support elements, along with the above-described re-enforcement of the sole by the flat portion of the base element, reduce the risk of a pronation.

Figure 5:
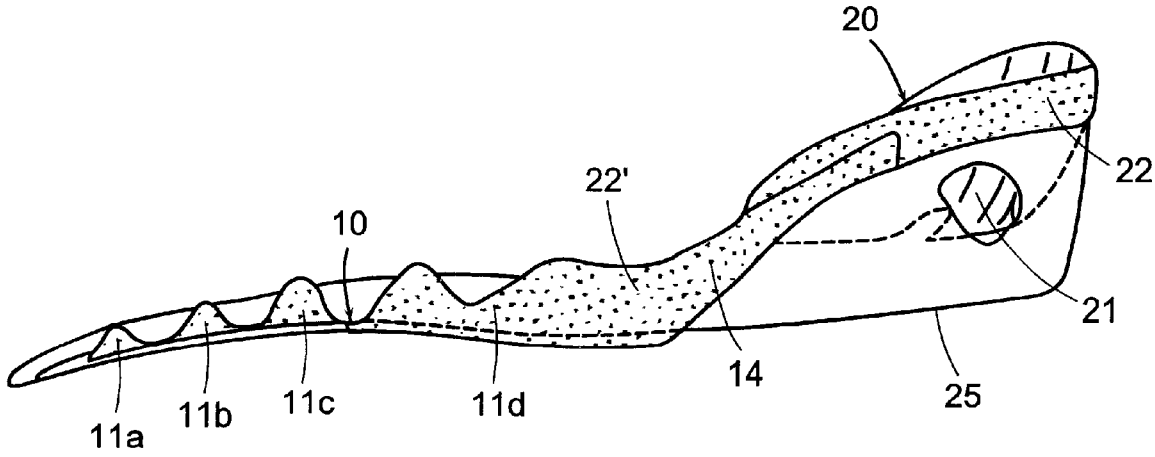
FIG. 5 is a schematic side view of a stability element and sole according to the present invention.

In the embodiment shown in FIG. 2, the support elements 11*a* to 11*d* extend upwardly on a side of a sole ensemble 25 see FIG. 5. In another embodiment, the support elements extend downwardly on the side of the sole ensemble, in particular if the stability element is arranged in the upper layers of the sole ensemble. An additional embodiment combines the two alternatives.

Figure 3:
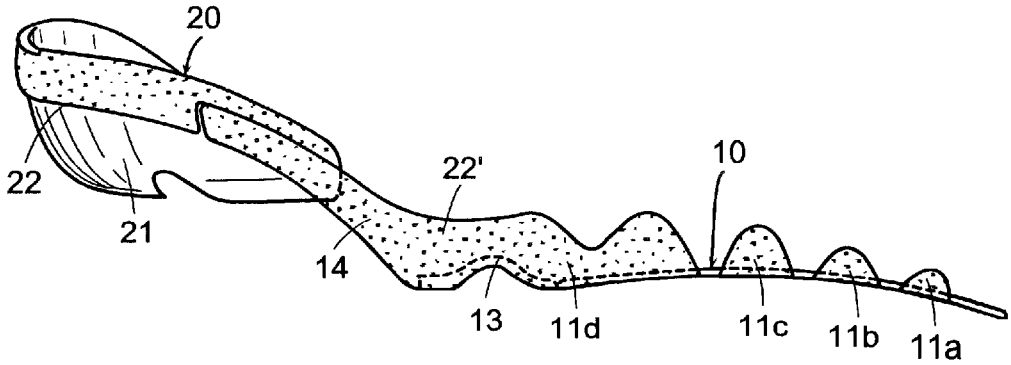
FIG. 3 is a side view of the stability element of FIG. 2.
Figure 4:
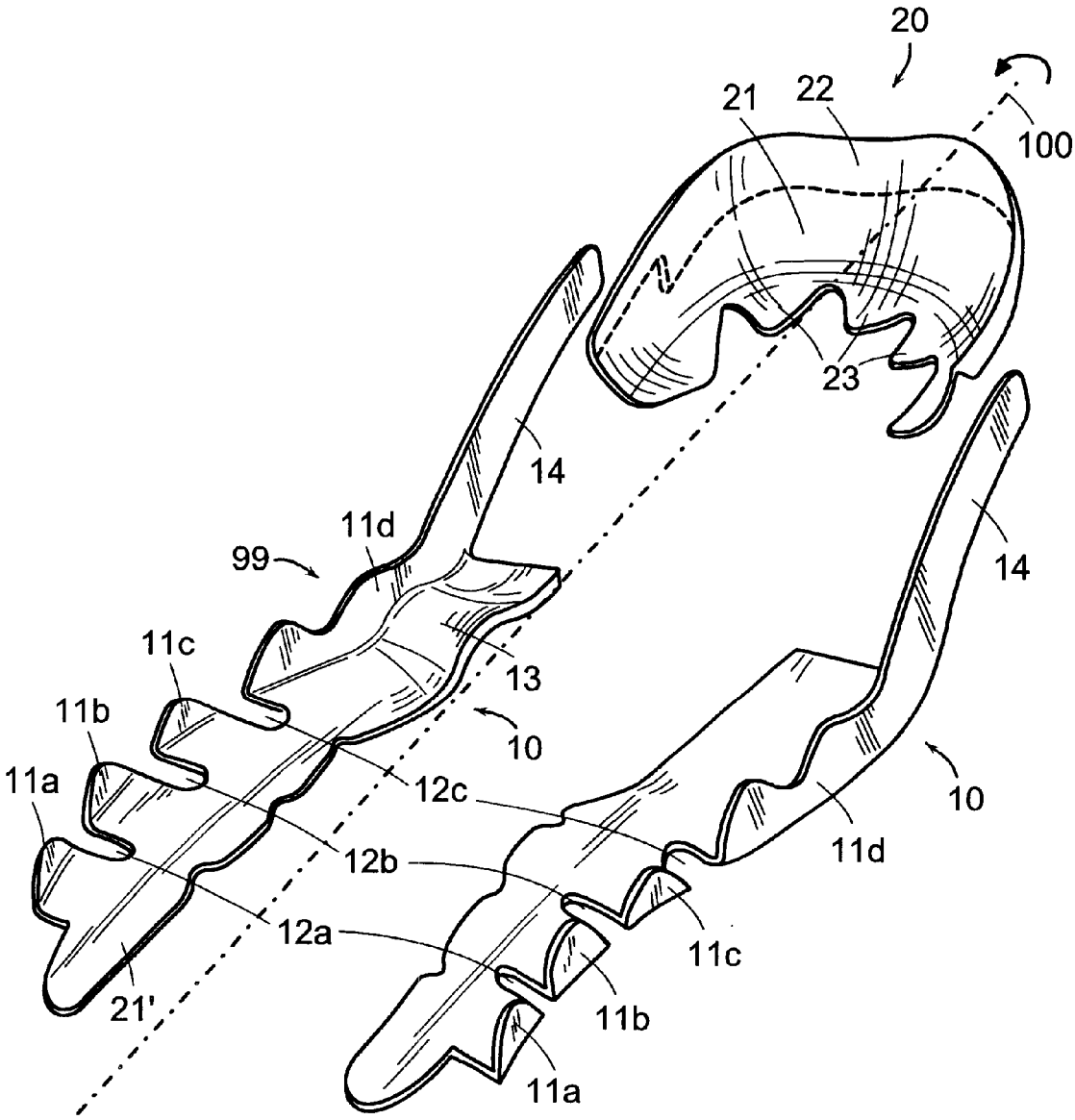
FIG. 4 is a perspective schematic view of an embodiment of first and second base elements and a sheet of a stability element according to the present invention.

In the embodiment shown in FIGS. 2 and 3, the supporting elements are essentially shaped as triangles; however, other shapes are possible, such as rectangular or arcuate. The greater the area of the side of the sole ensemble encompassed by the support elements 11*a* to 11*d*, the greater the compression stability in the medial or lateral portion of the sole ensemble.

For lateral support of the foot, for example where the shoe is used in a sport with many changes of direction, such as handball, the support elements 11*a* to 11*d* may further extend over the edge of the sole ensemble thereby exerting a direct stabilizing force on the shoe. Additional lateral support may be achieved by the addition of a second base element similar to base element 10 shown in FIG. 2, and including corresponding support elements arranged on the side opposite the first base element 10.

To increase the flexibility of the base element 10 in the longitudinal direction and to hinder as little as possible the natural pushing-off of the foot, the base element 10 may include up to three slits 12*a* to 12*c*, which are preferably oriented in a transverse direction. Other embodiments may also include not only various numbers of slits, but also different arrangements of the slits in the base element 10. Further, openings in the longitudinal direction may be provided in the base element 10 to increase flexibility in the transverse direction.

Whereas the front part of the base element 10 may be optimized by the addition of slits 12*a* to 12*c* for flexibility in longitudinal direction, the rear part of the base element 10 may be re-enforced to support the arch of the foot. FIG. 2 shows on example of an arch support 13. Along with support element 11*d* on the side, support of the arched mid-portion of the foot against vertically acting forces is achieved. The extension in the longitudinal and transversal direction as well as the height of the arch support 13 depends on the use of the shoe. In sports with many leaps and landings and high stress on the longitudinal and lateral arch of the foot, the dimensions of the arch support 13 of the base element 10 will be greater typically than in arch supports used in running shoes.

The rear end of the base element 10 includes a ridge 14 extending rearward from the side of the base element 10. Ridge 14 interconnects the base element 10 with the heel support 20. Additional interconnecting elements may be located in the center of the sole. The shape and material of ridge 14 defines the flexibility for relative movement of the heel support 20 with respect to the base element 10. The ridge 14 shown in FIGS. 2 and 3 supports the foot in the longitudinal direction; however, at the same time, the ridge 14 allows torsional movement of the forefoot portion with respect to the heel portion around longitudinal axis 100.

As shown in FIG. 2, the heel support 20 completely encompasses the heel of the shoe. As with the support elements 11*a* to 11*d* of the base element 10, the compressibility of the sole is increased, because an expansion of the sole material under high pressure to the side, as it arises, for example, during the landing with the heel, is avoided. The heel support typically may include an inner part 21 that extends inside or below the sole ensemble and an external part 22, which encloses frame-like the rearfoot portion of the sole. In one embodiment, the inner part 21 includes three inwardly directed projections 23. In another embodiment, the internal part 21 extends below the entire heel. Whereas the inner part 21 is thereby invisibly integrated into the sole ensemble, the external frame-like part 22 provides, apart from support, the possibility to influence the visible design of the shoe. Similarly, with respect to ridge 14, the visible region of the ridge 22' may be revealed on a medial or lateral side of the center of the sole.

As material for the stability element, a composite material of carbon fibers embedded into a matrix of resin may be used. This material combines high stability with low weight. Other suitable materials include glass fibers or para-aramid fibers, such as the Kevlar® brand sold by DuPont. These materials combine good elasticity values with low weight. Also, steel or other elastic metal alloys could be used. Suitable plastic materials include nylon, thermoplastic polyether block amides, such as the Pebax® brand sold by Elf Atochem, and thermoplastic polyester elastomers, such as the Hytrel® brand sold by DuPont. Plastic materials have advantages with respect to production by injection molding. Other suitable materials will be apparent to those of skill in the art. The stiffness of the stability element is determined not only by the material itself and its thickness, but also by its attachment to the surrounding sole material.

Having described embodiments of the invention, it will be apparent to those of ordinary skill in the art that other embodiments incorporating the concepts disclosed herein may be used without departing from the spirit and scope of the invention. The described embodiments are to be considered in all respects as only illustrative and not restrictive. Therefore, it is intended that the scope of the present invention be only limited by the following claims.

What is claimed is:

1. A shoe including a sole ensemble and a stability element for selective support of single parts of the sole ensemble, the stability element comprising:

a) a first base element extending from a rearfoot portion into a forefoot portion forward of an arch area of the shoe along as one medial side and a lateral side of the shoe; and b) at least one support element extending from the base element and encompassing the sole ensemble on the only one of the medial side and the lateral.

2. A shoe according to claim 1, wherein the support element encompasses the sole ensemble in at least one of an upwardly direction and a downwardly direction.

3. A shoe according to claim 1, wherein the stability element further comprises a heel support connected to the first base element, the heel support at least partially encompassing a heel portion of the shoe.

4. A shoe according to claim 3, wherein the stability element further comprises a second base element separate from the first base element and extending on an opposite side of the forefoot portion with respect to the first base element, the second base element comprising at least one support element extending from the second base element and encompassing the sole ensemble on the opposite side.

5. A shoe according to claim 1, wherein the first base element forms at least one slit in the forefoot portion.

6. A shoe according to claim 1, wherein the first base element comprises an additional support in the rearfoot portion for an arch of a foot.

7. A shoe according to claim 3, wherein a connection between the first base element and the heel support includes a ridge with torsional flexibility to allow a turning movement of the first base element with respect to the heel support.

8. A shoe according to claim 3, wherein the heel support fully encompasses the heel portion.

9. A shoe according to claim 4, wherein a portion of at least one of the first and second base elements and the heel support is embedded in the sole ensemble and a portion of at least one of the first and second base elements and the heel support is visible from outside the sole ensemble.

10. A shoe according to claim 1, wherein the at least one support element further encompasses a foot for support of single parts of the foot.

* * * * *

UNITED STATES PATENT AND TRADEMARK OFFICE

CERTIFICATE OF CORRECTION

PATENT NO. : 6,497,058 B2
DATED : December 24, 2002
INVENTOR(S) : Dietrich et al.

It is certified that error appears in the above-identified patent and that said Letters Patent is hereby corrected as shown below:

Column 7,
Line 3, please delete the word "as" and replace it with the word -- only --.
Line 3, please add the words -- of a -- after the word "one".
Line 7, please insert the word -- side -- after the word "lateral".

Signed and Sealed this

Eleventh Day of March, 2003

JAMES E. ROGAN
*Director of the United States Patent and Trademark Office*